US008515651B2

(12) United States Patent
De Tricaud et al.

(10) Patent No.: US 8,515,651 B2
(45) Date of Patent: Aug. 20, 2013

(54) METHOD FOR STABILIZING A CONTROLLER AND CORRESPONDING CONTROLLER DEVICE

(75) Inventors: Stephane De Tricaud, Stuttgart (DE); Thomas Mueller, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 593 days.

(21) Appl. No.: 12/740,958

(22) PCT Filed: Oct. 17, 2008

(86) PCT No.: PCT/EP2008/064012

§ 371 (c)(1),
(2), (4) Date: Aug. 20, 2010

(87) PCT Pub. No.: WO2009/059880

PCT Pub. Date: May 14, 2009

(65) Prior Publication Data

US 2010/0312452 A1 Dec. 9, 2010

(30) Foreign Application Priority Data

Nov. 7, 2007 (DE) ..... 10 2007 053 085

(51) Int. Cl.
*F02D 41/16* (2006.01)

(52) U.S. Cl.
USPC ..... 701/107; 701/114; 123/339.15; 123/479; 123/198 D

(58) Field of Classification Search
USPC ..... 701/107, 114; 123/198 D, 339.15, 123/406.13, 479, 435–436, 456, 399
See application file for complete search history.

(56) References Cited

U.S. PATENT DOCUMENTS

| | | | | |
|---|---|---|---|---|
| 4,996,965 | A * | 3/1991 | Onari et al. | 123/492 |
| 5,047,944 | A * | 9/1991 | Ishikawa et al. | 701/114 |
| 5,048,495 | A * | 9/1991 | Onari et al. | 123/492 |
| 5,484,351 | A | 1/1996 | Zhang et al. | |
| 6,427,100 | B1 * | 7/2002 | Kaku et al. | 701/22 |
| 6,968,677 | B2 * | 11/2005 | Tamura | 60/277 |
| 7,024,304 | B2 * | 4/2006 | Fukasawa et al. | 701/111 |
| 7,295,913 | B2 * | 11/2007 | Matsuda et al. | 701/103 |
| 7,835,844 | B2 * | 11/2010 | Werner et al. | 701/68 |
| 8,033,266 | B2 * | 10/2011 | Akagi et al. | 123/361 |

FOREIGN PATENT DOCUMENTS

| | | |
|---|---|---|
| DE | 43 04 779 | 12/1993 |
| DE | 196 12 455 | 10/1997 |
| EP | 0 279 375 | 8/1988 |
| JP | 9-4492 | 1/1997 |

OTHER PUBLICATIONS

Wendeker M et al.: "Adaptive Control of the Idle Speed Using Bypass Valve" SAE Technical Paper Series, Society of Automotive Engineers, Warrendale, PA, US, Jan. 1, 2003, p. 6 XP001155415.

* cited by examiner

*Primary Examiner* — Hai Huynh
(74) *Attorney, Agent, or Firm* — Kenyon & Kenyon LLP

(57) ABSTRACT

The invention relates to a method for stabilizing a controller and to the use of that method for stabilizing a controller system in an internal combustion engine. It is proposed that the stability of the controller first be established or excluded, that the control characteristic of the controller be altered and that the stability be checked again, and that those steps be repeated in a loop. For use in internal combustion engines, it is proposed that the order of precedence for the stabilization be specified and optionally made dependent on external ambient parameters.

11 Claims, 3 Drawing Sheets

1
2
3
(3ab)
(3aa)
4
5a
(5ab)
5b
(5aa)
6
7a
(7)
7b
8
9a
(9ab)
9b
(9aa)
10
(10=3)

METHOD FOR STABILIZING A CONTROLLER AND CORRESPONDING CONTROLLER DEVICE

FIELD OF THE INVENTION

The present invention relates to a method for stabilizing a controller and to the use of that method for stabilizing a controller system in an internal combustion engine, and to a controller device for carrying out the method.

BACKGROUND INFORMATION

For the automatic control of machines, and of various kinds of controlled systems in general, standard control circuits are known which react to the change in a controlled variable with different strategies. It is known to use for that purpose controllers that alter a manipulated value in proportion to a change in the controlled variable relative to a setpoint value so as to compensate for the external disturbance variable using the manipulated value. These are so-called P elements. In addition, controllers are also known that constantly increase their manipulated value in proportion to the actual quantity (I element), and those which alter the manipulated variable in proportion to the change in the controlled variable with time (D element). Controllers that combine all three strategies are called PID controllers and are distinguished by especially rapid control of the controlled variable without control oscillation occurring in the process. If various controllers having different controlled variables that may affect one another are being used for controlling a machine, it is possible that the controller system will experience control oscillation. It is also possible that the machine will change or become worn in the course of that use, thereby giving rise to control oscillations or control instabilities.

SUMMARY OF THE INVENTION

Frequently, several controlled variables are controlled in machines simultaneously, for example in modern internal combustion engines. In that situation, it is not guaranteed that by variation of different manipulated variables the individual controlled variables may be controlled independently of one another, and therefore control oscillations may occur because in some cases more than two controllers work in opposition to one another. For that reason, problems with the stability of the idling in internal combustions engines frequently occur in daily use, and those instabilities may lead to increased noise and vehicle vibration which may be heard or also felt by the driver.

The causes are not necessarily attributable, however, to inadequate tuning of the control circuits relative to one another, but may also be caused by a change in the machine itself due to aging, such as changes in the drivetrain of a vehicle caused by wear and tear and/or as a result of wearing out or because of an unfavorable combination of different engine elements which in their operation are close to the limit of an acceptable tolerance range. Owing to the variety of possible causes and especially the variety of combinations of causes, in developing a motor vehicle it is scarcely possible to impossible for the control circuits of an internal combustion engine in the motor vehicle to be adequately safeguarded against potential unstable conditions. Unstable control conditions in an internal combustion engine may cause harmless to imperceptible mistuning of the engine running characteristics, but may also be so noticeable that a user of the vehicle finds the instability irritating and therefore finds fault with the vehicle as a whole.

The exemplary embodiments and/or exemplary methods of the present invention provides a control loop having at least one step for detecting an instability of the controller, at least one step for altering the characteristic of the controller and at least one step for detecting the alteration of the control behavior of the controller, and a controller device for carrying out the method.

In accordance with the exemplary embodiments and/or exemplary methods of the present invention it is proposed that a further method be added to known methods for controlling a controlled variable, in order to ensure sustained stability of the control behavior of a controller. Provision is made in that respect for the instability of a controller to be established in at least one first step. The instability of a controller may be established, for example, by a statistical evaluation of the control behavior. In the best case, it has proved advantageous for that first step to consist in calculating the standard deviation of the controller output variable. The standard deviation ascertained is compared with a predefined maximum standard deviation and, if the maximum standard deviation is exceeded, the instability is established. In a second step, the characteristic of the controller is altered. In the simplest case, the change to the characteristic may be made by altering the output value of the controller, for example multiplying it by a factor or dividing it by a divisor.

In that manner the manipulated variable is increased or decreased relative to the disturbance variable, which results in a change in the characteristic of the controller. Alteration of the characteristic is followed according to the exemplary embodiments and/or exemplary methods of the present invention by detection of the change in the control behavior. That detection may be carried out in the simplest case by performing statistical analysis of the control behavior again. If, for example, the standard deviation of the output variable of the controller is determined again, the control loop may begin again at the first step and may establish again whether the characteristic of the controller, in this case the standard deviation of the output variable of the controller, is now within a predefined range of the standard deviation.

It is, however, possible that the single alteration of the characteristic of the controller will lead to increased instability of the controller, for example as a result of the standard deviation becoming greater. In that case, it is possible to alter the output variable of the controller by dividing it by a value instead of multiplying it by a factor, and thereby reduce the effective amplitude of the output variable of the controller. In the statistical analysis, however, it is the actual output value of the controller that is used and not the value altered by the factor or divisor in order to avoid falsification by the multiplication or by the division.

When used in an internal combustion engine, that kind of stabilization of a controller has the advantage that, for example, the idling is stabilized and does not fluctuate erratically or periodically about a value. The improved idling behavior caused by the method of the present invention for stabilizing a controller allows considerable cost-savings to be made in quality control at the production plant since quality control in respect of controller stability may be dispensed with while vehicle emissions and passenger compartment noise may still be minimized and also the driving characteristics of the engine may still be optimized.

In order to avoid infinite adaptation of the controller characteristic, which may similarly manifest itself in control oscillation, it is provided that the number of control cycles is limited. If, for example, it is not possible for stabilization to be achieved by the method of the present invention or if the control behavior fluctuates despite the stabilization measure, it may generally be assumed that an engine component is not working properly or is worn out. In that case, it would be necessary to diagnose the cause of the instability of the engine and, where appropriate, replace the components causing it.

Since stabilization often has to be carried out under varying external conditions, it not being possible for the parameters of the external conditions to be controlled, it has been found advantageous for stabilization to be carried out in dependence upon the external conditions. For this it is possible to draw upon the external parameters atmospheric pressure, engine temperature and fuel temperature, with a stabilization parameter being associated in each case with a combination of the external conditions mentioned above. It has been found advantageous in that respect that, if all of the above-mentioned external parameters are above a preselected threshold and at the same time the idling lasts for a preselected period, then the function for stabilizing the controller is executed. That avoids over-compensation, which, besides constant alteration of the controller parameters, also the occurrence of control oscillations occurring as a result of over-compensation through controlling unduly frequently are avoided. In accordance with the exemplary embodiments and/or exemplary methods of the present invention it is provided that the function for stabilizing the controller is inhibited if one of the parameters atmospheric pressure, engine and fuel temperature, and duration of idling falls below a preselected value.

So as not to have to perform simultaneous stabilization of various controllers with obvious dependencies of the controlled variables, it has been found advantageous to perform a predetermined sequence for stabilization of individual controllers of the internal combustion engine when more than one controller in an internal combustion engine is to be stabilized at the same time. In the case of this kind of stabilization of the controllers in an internal combustion engine, it is provided that three variables are made available for simultaneous stabilization of various controllers. A first variable applies to the sequence of the controllers to be stabilized, a second variable applies to the stability condition of the controller system, and a third variable applies to the last stabilized controller together with the successful stability measure, that is, for example, multiplication or division of the controller output signal, so that a central unit is able to stabilize the entirety of the controllers.

Provided that a first stabilization of a first controller has first resulted in stabilization of the first controller, in a further case of a detected instability of a further controller that controller may be stabilized according to the invention in the stabilization sequence. The particular controller to be stabilized is determined by the variable first mentioned by way of example above. A sequence of stabilization is, of course, to be carried out only if more than one controller exhibits an unstable control behavior.

The stability condition of the controller system is also recorded by a variable, the number of conditions of the system as a whole being a power of two, with each controller affecting the system as a whole with two conditions, namely "stable" and "non-stable".

The last control loop is recorded in the third variable. Using that information it is possible to record the last measure for stabilization of the last controller and, where appropriate, repeat it in identical or modified form.

The exemplary embodiments and/or exemplary methods of the present invention will be described in detail with reference to the accompanying Figures.

DETAILED DESCRIPTION

Figure 1:
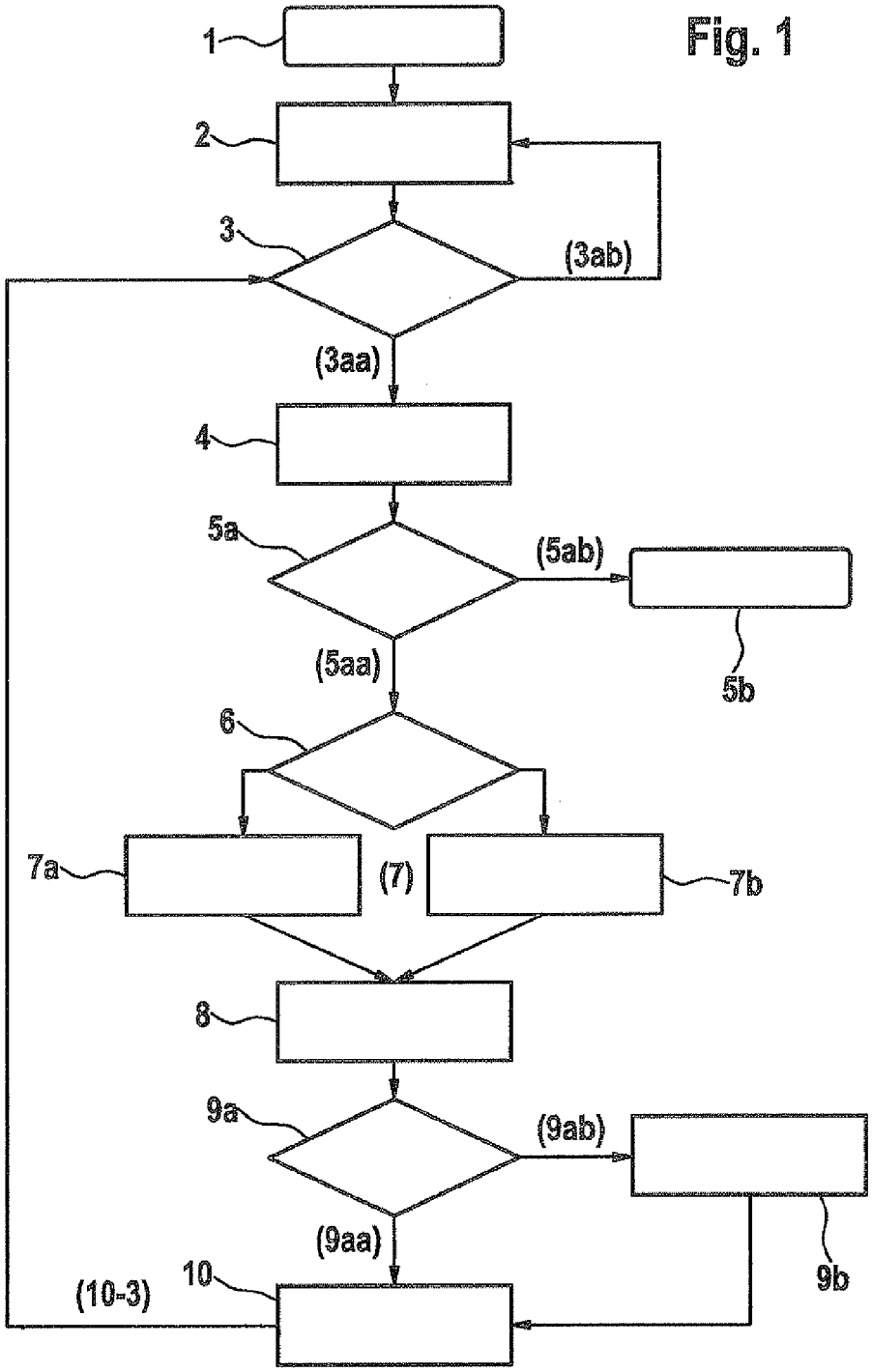
FIG. 1 is a flow diagram of a sequence of steps according to the invention for the stabilization of a controller.

FIG. 1 shows a flow diagram of a method according to the invention for stabilizing a controller. Beginning at the start 1 where an electronic unit or a microcontroller for carrying out the method is given the possibility of initializing, recording 2 of the standard deviation $\sigma_1$ of the controller behavior follows. This is done in the simplest case by recording the controller output variable, for example a voltage, a maximum current or a digital value, before conversion into a manipulated variable, using a suitable input element and by converting it into a numerically recordable value. The recording 2 of the standard deviation $\sigma_1$ is done by repeatedly recording the controller output variable at fixed times or also at reversal points of the controller output variable, so that the respective maximum value of the controller output variable is recorded. In the case of an on/off controller, recording may be carried out in accordance with the mark-to-space ratio.

After a sufficiently large number of values for a statistical analysis has been recorded, the standard deviation $\sigma_1$ is ascertained by known calculation methods and is stored internally for further use in the method according to the invention. The recording 2 of the standard deviation $\sigma_2$ is followed by a comparison 3 with a preselected maximum standard deviation $\sigma_{max}$. If the recorded standard deviation $\sigma_1$ is below a predefined value $\sigma_{max}$, that is to say, if it is within an acceptable range, the method takes path 3*ab* and the standard deviation $\sigma_1$ of the controller is ascertained again. The closed loop between step 2 and step 3 is repeated until the standard deviation $\sigma_1$ of the controller output variable exceeds a preselected value $\sigma_{max}$ and thus indicates an unacceptable condition of the controller that is to be stabilized. The method according to the invention then takes the next step. At this point 4, first a counter n, which indicates how often an attempt has been made to stabilize the controller, is incremented. If that counter n exceeds a preselected value $n_{max}$ ascertained in comparison step 5*a*, the attempt to stabilize the controller is abandoned since, if a maximum number $n_{max}$ is exceeded, it may be assumed that a part of the system as a whole, in this case the internal combustion engine, is defective or worn and therefore needs to be replaced.

The method according to the invention then takes step 5*ab* and stops at step 5*b*. If, however, the value of the counter n is less than the maximum value $n_{max}$, the method takes path 5*aa* to step 6 in which the method for changing the control behavior is ascertained. That choice is recorded by a variable or "flag" which indicates either a multiplication by a value greater than 1 or a division by a value greater than 1. According to that variable, the "flag", the output of the controller to be stabilized is multiplied by a value greater than 1 or divided by a value greater than 1. Once the change in the controller behavior has been established, the controller behavior is determined again in step 8 and the value of the standard deviation $\sigma_2$ is temporarily stored for further use. In step 9, the standard deviation $\sigma_2$ is compared with the standard deviation $\sigma_1$ ascertained at the beginning. If the new standard deviation $\sigma_2$ is below the first standard deviation $\sigma_1$, the method takes the path 9*aa*. Then, the standard deviation $\sigma_2$ is stored as the standard deviation $\sigma_1$ in step 10 and the method is continued by the jump 10-3 to step 3 where the method jumps into the closed loop again between step 2 and step 3. If, however, the new value for the standard deviation $\sigma_2$ is greater than the standard deviation $\sigma_1$ ascertained at the beginning, the variable that indicates the procedure for changing the controller behavior is changed, standard deviation $\sigma_2$ is stored as standard deviation $\sigma_1$ in step 10 and the method then makes the jump 10-3 again.

If a controller system is to be stabilized, a sequence in which the individual controllers are to be stabilized is specified. This has the advantage that not all the controllers are stabilized simultaneously, whereby the control oscillation of the system as a whole might be considerably increased instead of being reduced. Once a first controller has been stabilized, a second controller is stabilized in sequence according to the flow diagram shown in FIG. 1 and the method is continued for further controllers until all the controllers have been stabilized.

The sequence for stabilization may be established by the stability status defined in the following Table, or may also follow a different sequence.

TABLE 1

Stability Status of a Controller System of Controllers for Idling Speed, Rail Pressure and Exhaust Gas Recirculation

| idling controller | rail pressure controller | exhaust gas recirculation controller | stability status | sequence |
|---|---|---|---|---|
| stable | stable | stable | 0 | a |
| unstable | stable | stable | 1 | b |
| stable | unstable | stable | 2 | c |
| stable | stable | unstable | 3 | d |
| stable | unstable | unstable | 4 | e |
| unstable | unstable | stable | 5 | f |
| unstable | stable | unstable | 6 | g |
| unstable | unstable | unstable | 7 | h |

In the case where the above stability status table is used for the sequence for stabilizing the controllers, on detection of an unstable idling controller, first that controller is stabilized (sequence b). If in a fresh phase the instability of two controllers is determined, for example stability status 4, 5 or 6, a sequence e, f or g preselected for that stability status is followed for stabilization of the individual controllers, in which sequence the individual controllers are stabilized in order to avoid a progressive increase in the amplitude of the controller instability of the controller system.

In embodying the invention, it is provided that, for external ambient parameters, such as atmospheric pressure, engine temperature and fuel temperature, a respective parameter set of factors or divisors in each case is provided for the individual controller output variables for stabilization purposes. Equally, it is possible to provide the maximum number $n_{max}$ of stabilization attempts for each combination of atmospheric pressure, engine temperature and fuel temperature.

In addition, it is also possible to store a table of factors/divisors as a function of engine speed in a table in the form of a characteristic curve. The factors come about as a result of the fact that, for every entry, by multiple multiplication and/or division a value for the controller concerned has been produced for the operating parameter combination under consideration, which value is provided in the table. If those external operating parameters are detected, those factors/divisors are assigned to the individual controllers and the controller output variables are linked to those factors/divisors, thereby avoiding a stabilization cycle since the correct value for the stabilization is immediately available.

Ultimately, a comprehensive table of controller factors/divisors may be stored as a complex volume of data for which one set of parameters in each case is provided for adjusting the controller behavior and the maximum acceptable number of stabilization attempts. In daily use, the controllers are then adjusted and stabilized for every engine state in dependence upon the external conditions. If the table is sufficiently large and if the spacing of the individual temperatures and pressures is sufficiently fine, a large number of different control parameters may be adjusted in that manner, with the result that the internal combustion engine to be controlled may be controlled in a stable manner over a large pressure and temperature range, the control parameters being adapted to the ambient parameters.

Figure 2:
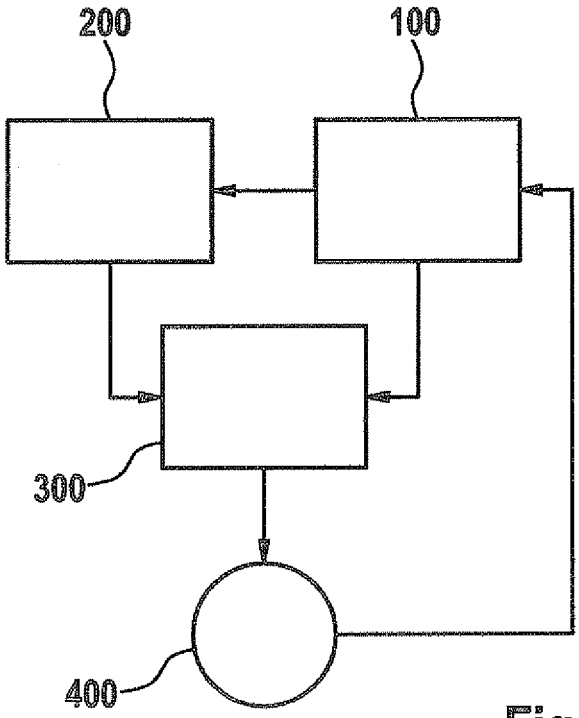
FIG. 2 is a block diagram of a controller device according to the invention.

FIG. 2 shows a block diagram of a controller device according to the invention which has a unit 100 for controlling a controlled variable 400, a unit 200 for detection of an instability of the controller device and a unit 300 for alteration of the characteristic of the controller device. The controller device according to the invention operates according to the method illustrated in FIG. 1. If unit 100 for control is stable, unit 300 does not alter the characteristic of the controller. If, however, an instability is determined by unit 200, unit 300 is caused to alter the characteristic of controller 100 in accordance with the invention.

Figure 3:
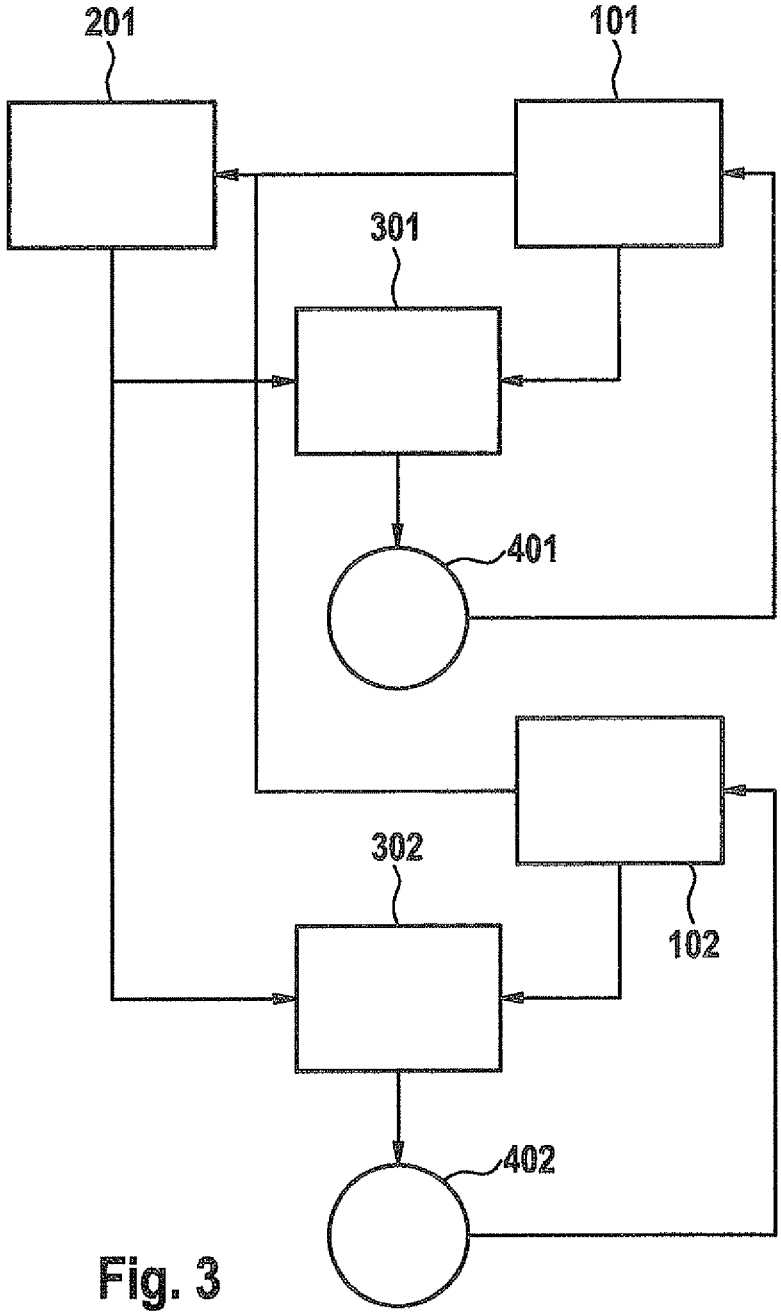
FIG. 3 is a block diagram of a stabilization device for more than one controller.

FIG. 3 shows a block diagram of a group of controllers that are stabilized together according to the invention by a unit 201 for detection of an instability and stabilization of the controllers. In this block diagram, two simple units 101 and 102 are shown for controlling one controlled variable 401 and 402 each, unit 201 stabilizing both units 101 and 102 by the method according to the invention in which units 301 and 302 for alteration of a controller characteristic alter the characteristic of controllers 101 and 102 by multiplication or division of the controller output value.

What is claimed is:

1. A method for stabilizing a controller using a control loop, the method comprising:

detecting an instability of the controller;

altering a characteristic of the controller; and detecting an alteration of the control behavior of the controller.

2. The method of claim 1, wherein a standard deviation of the controller output signal is recorded over a predefined period of time and the standard deviation is compared with a previously selected value for detecting the instability.

3. The method of claim 1, wherein one of a multiplication and a division of the controller output signal by a variable value is performed for altering the characteristic of the controller.

4. The method of claim 1, wherein a standard deviation of the controller output signal is recorded over a predefined period of time after alteration of a characteristic of the controller, and the standard deviation of the controller output signal is compared before altering the characteristic of the controller.

5. The method of claim 1, wherein an identical repetition of a measure for altering a controller characteristic is performed if a previously performed measure for altering the controller characteristic has led to a reduction in an instability, and wherein a modified repetition of the measure for altering the controller characteristic is performed if a previously performed measure for altering the controller characteristic has led to an increase in the instability.

6. The method of claim 1, wherein there is a predefined and maximum number of a repetition of the control loop cycles.

7. the method of claim 1, wherein an idling of an internal combustion engine is stabilized.

8. The method of claim 7, wherein a simultaneous stabilization of the controller characteristic of controllers for each of an idling speed, a rail pressure, and an air mass supplied is performed.

9. The use of the method of claim 8, wherein there is a preselected order of precedence for stabilizing the controllers.

10. The method of claim 7, wherein there is a maximum number of control loop cycles for at least one of (i) each predefined atmospheric pressure, (ii) each fuel temperature, and (iii) each engine temperature.

11. A controller device, comprising:

a controller arrangement;

a detecting unit;

an altering unit; and a stabilizing arrangement to stabilize the controller arrangement by using a control loop and by using the detecting unit to detect an instability of the controller arrangement, using the altering unit to alter a characteristic of the controller arrangement, and by detecting an alteration of the control behavior of the controller arrangement.

* * * * *

UNITED STATES PATENT AND TRADEMARK OFFICE

CERTIFICATE OF CORRECTION

PATENT NO. : 8,515,651 B2
APPLICATION NO. : 12/740958
DATED : August 20, 2013
INVENTOR(S) : De Tricaud et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 698 days.

Signed and Sealed this
Fifteenth Day of September, 2015

Michelle K. Lee

Michelle K. Lee
*Director of the United States Patent and Trademark Office*